United States Patent [19]

Won

[11] Patent Number: 4,605,141

[45] Date of Patent: Aug. 12, 1986

[54] OPENING MEANS HAVING HOLD DOWN MEANS

[76] Inventor: Duksoo Won, West Haverstraw, N.Y.

[21] Appl. No.: 707,203

[22] Filed: Mar. 1, 1985

[51] Int. Cl.[4] ..... B65D 41/32

[52] U.S. Cl. ..... 220/269; 220/336

[58] Field of Search ..... 220/269, 336, 271, 272, 220/273, 270

[56] References Cited

U.S. PATENT DOCUMENTS 4,433,792 2/1984 Mandel ..... 220/336

4,442,950 4/1984 Wilson ..... 220/336

*Primary Examiner*—George T. Hall

*Attorney, Agent, or Firm*—Birch, Stewart, Kolasch and Birch

[57] ABSTRACT

A container comprising a top wall having a rupturable score line defining a permanent top wall portion and an opening closure portion; pivot means spaced from said drinking opening; and a pull tab pivotally connected with said pivot means, said pull tab comprising a solid pull tab portion having a size at least as large as said opening whereby said pull tab portion can be pivoted over said opening to close said opening.

12 Claims, 5 Drawing Figures

OPENING MEANS HAVING HOLD DOWN MEANS

FIELD OF THE INVENTION

The present invention relates to containers for carbonated and noncarbonated beverages and other fluids.

BACKGROUND OF THE INVENTION

Metallic containers which utilize a pull tab to rupture a score line which defines an opening in the container are well known in the art and are used extensively in the soft drink industry. One disadvantage of these containers is that once they are opened if they are knocked over or subjected to sudden movement, the beverage contained in the container will spill out of or splash out of the container.

SUMMARY OF THE INVENTION

The present invention relates to containers for liquids such as carbonated and noncarbonated beverages, brake fluid, gasoline additives and other fluids. In particular, the present invention relates to containers which have a pull tab on the top wall thereof wherein when the pull tab is lifted, a closure portion which is defined by a rupturable score line is pressed into the container. Generally, the rupturable score line is formed substantially but not entirely around the opening portion so that when the score line is ruptured by pressure from the pull tab, the score line ruptures and the closure portion will bend downwardly into the container while remaining an intrical part of the top wall. In this way, after the container is opened there will be no loose pieces such as portions of the top wall or pull tabs to litter the surrounding area. The container of the present invention utilizes a specially designed pull tab which is capable of rupturing a score line which defines an opening when pulled and which can be pivoted to a closing position whereby the pull tab portion of the pull tab covers the opening formed by rupturing of the score line.

In one aspect of the invention, the metallic container comprises a top wall having a rupturable score line defining a permanent top wall portion and an opening closure portion; pivot means spaced from said drinking opening; and a pull tab pivotally connected with said pivot means, said pull tab comprising a solid pull tab portion having a size at least as large as said opening and a piercing portion, said pull tab being pivotal from an opening position wherein when said pull tab portion is lifted, said piercing portion presses on said opening closure portion to rupture said score line and form a drinking opening to a closing position wherein said pull tab portion completely covers said drinking opening. The pivot means is preferably a pivot stud which is provided near the center of the top wall and the pull tab is provided with a pivot hole between the opening portion of the pull tab and the pull tab portion of the pull tab. A cut through score line may be located in the pull tab portion adjacent to the hole in the pull tab. The cut through score line allows the pull tab to be raised and pivoted about a horizontal pivot axis without imparting undue strain onto the pivot stud.

In order to prevent liquid in the container from escaping through the cut through score line, the distance from the center of the pivot opening to the cut through score line is less than the distance from the center of the pivot stud to the adjacent edge of the rupturable score line whereby when the pull tab is pivoted to the closing position, the cut through score line is located entirely over the top wall portion of the top wall and is not located over the opening.

The container may also be provided with a pivotal hold down tab located adjacent to the opening wherein the hold down tab is pivotal from a first normal position wherein the hold down tab is located entirely over the permanent top wall portion to a second hold down position wherein a portion of the hold down tab is located over the opening whereby the hold down tab presses said pull tab portion onto said opening when the pull tab is in the closing position. By use of this hold down tab more effective sealing of the opening can be achieved.

The container may also be provided with sealing means secured to the underside of the pull tab portion whereby when the pull tab is pivoted to the closing position, the sealing means seals the opening. The sealing means may comprise a ring of compressible material which has a shape which corresponds to the shape of the opening. The outer circumference or periphery of the sealing means may have a size which is larger than, the same as or slightly smaller than the size of the opening. If the sealing means is larger than the opening, when the hold down tab presses the closure portion of the pull tab onto the container top, the sealing means will seal the portion of the top wall which is immediately adjacent to the opening. If the sealing means has an outer circumference or diameter which is substantially the same size as the opening, the sealing means can be pressed into the opening. Since the sealing means can be formed of a flexible or compressible material, the sealing means may tightly fit into the opening and therefore assist in holding the pull tab portion of the pull tab over the opening in the closing position.

DETAILED DESCRIPTION

Figure 1:
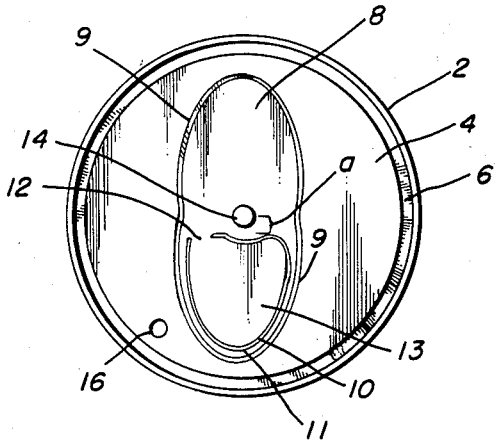
FIG. 1 is a top view of one embodiment of the invention with the pull tab and hold down tab removed.

As shown in FIG. 1, the top of the container of the present invention comprises a rim 2, a top portion 4 having a flat surface and a depression 6 located between the top portion 4 and the rim 2. The top wall has a depressed flat surface 8 defined at least partially by a periphery 9. The depressed flat surface 8 has a shape which corresponds generally to the shape of a pull tab. The top wall also has a score line 10 and a rupturable score line 11 which define a closure portion 13. The closure portion 13 is surrounded substantially entirely by the weakened score line 11 except for the unweakened portion 12. A pivot 14 is provided near the center of the top wall. The center of the pivot 14 is spaced from the adjacent portion of the score line 11 by a distance "a". A hold down tab pivot 16 may also be provided adjacent to one side of the weakened score line 11.

Figure 2:
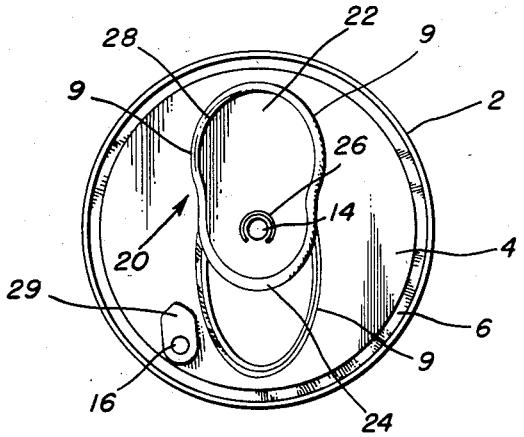
FIG. 2 is a top view of the container of the present invention with the pull tab and hold down tab in the opening position.
Figure 5:
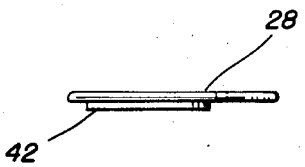
FIG. 5 is a side view of the pull tab of FIG. 4.

FIG. 2 illustrates the completed container. The container is provided with a pull tab having a pulling portion 22 and a piercing portion 24. The pulling portion 22 and the piercing portion 24 are separated by the pivot 14. The pulling portion of the pull tab is provided with a cut through score line 26 which extends from the pulling portion around both sides of the pivot 14 and into the opening portion 24. However, of course the cut through score line does not extend completely around the pivot 14. The entire periphery of the pull tab may be provided with a reinforcing or thickened periphery 28 which adds strength to the pull tab. A hold down tab 29 is pivotally connected to the pivot 16 at a point adjacent to the opening.

Figure 3:
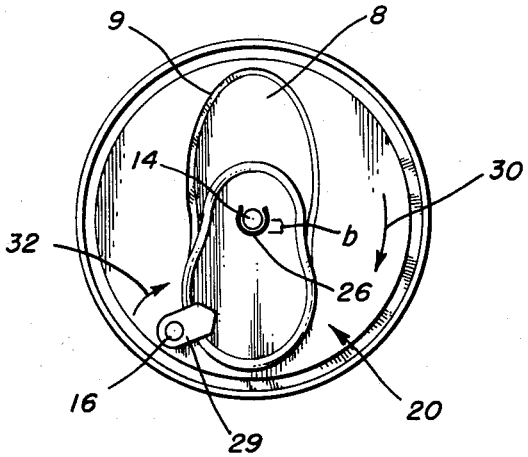
FIG. 3 is a top view of the container of the present invention with the pull tab and hold down tab in the closing position.

In use, when the pull tab is in the position shown in FIG. 2, the pulling portion is lifted and the piercing portion 24 presses the closure 13 to rupture the rupturable score line 11. As the pulling portion is raised, the closure portion 13 is pressed into the container and is folded or bent along the unweakened portion 12. At the same time, the cut through score line 26 allows the pulling portion to be lifted without imparting undue strain on the pivot 14. After the rupturable score line 11 has been broken and the closure portion 13 has been bent down into the container, the pull tab is rotated in the direction shown by arrow 30 in FIG. 3 to a closing position. In this position, the pulling portion 22 will entirely cover the opening formed along the rupturable score line 11. Because the distance "b" which extends from the center of the pivot 14 to the adjacent edge of the cut through score line 26 is smaller than the corresponding distance "a" from the center of the pivot 14 to the adjacent edge of the rupturable score line 11, the cut through score line 26 will be located entirely over the permanent top wall of the container and will not be located over the opening. In this way, leakage of the container contents through the cut through score line 26 is prevented or minimized. The hold down tab 29 can then be rotated in the direction of the arrow 32 to a closing position whereby the hold down tab 29 presses the pull tab portion of the pull tab onto the opening.

Figure 4:
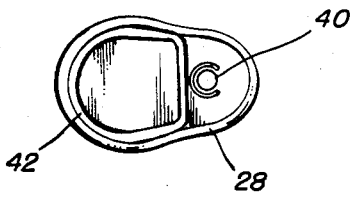
FIG. 4 is a bottom view of a type of pull tab which can be used in accordance with the present invention.

As shown in FIG. 4, the pull tab contains a hole 40 which is pivotally connected with the pivot 14. The pull tab also may be provided with a reinforced peripheral portion 28 by bending down the periphery of the pull tab. A ring of material such as a compressible material 42 can be provided on the bottom surface of the pull tab. The ring of sealing material 42 will have a shape which corresponds generally to the shape of the opening defined by the closure portion 13. If such a compressible material is provided on the bottom surface of the pull tab, the compressible material can aid in sealing the opening when the pull tab is in the closing position. If the sealing ring 42 is larger than the opening, the sealing ring will seal the periphery of the opening. If the outer periphery of the sealing ring 42 has a size substantially the same as the size of the opening, the sealing material can be pressed into the opening for sealing purposes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A metallic container, comprising:

a top wall having a rupturable score line defining a permanent top wall portion and an opening closure portion; pivot means spaced from said drinking opening; a pull tab pivotally connected with said pivot means, said pull tab comprising a solid pull tab portion having a size at least as large as said opening and a piercing portion, said pull tab being pivotal from an opening position wherein when said pull tab portion is lifted, said piercing portion presses on said opening closure portion to rupture said score line and form a drinking opening to a closing position wherein said pull tab portion completely covers said drinking opening; and a pivotal hold down tab located adjacent to said opening, said hold down tab being pivotal from a first normal position wherein said hold down tab is located entirely over said permanent top wall portion to a second hold down position wherein a portion of said hold down tab is located over said opening whereby said hold down tab presses said pull tab portion onto said opening.

2. The container of claim 1, wherein a pivot stud is provided near the center of said top wall, said pull tab is provided with a pivot hole between said opening portion and said pull tab portion and a cut through score line located in said pull tab portion adjacent to said hole.

3. The container of claim 2, wherein the distance from the center of said pivot opening to said cut through score line is less than the distance from the center of said pivot stud to the adjacent edge of said rupturable score line whereby when said pull tab is pivoted to said closing position, said cut through score line is located entirely over said top wall portion.

4. The container of claim 1, and further comprising sealing means secured to the underside of said pull tab portion of said pull tab whereby when said pull tab is pivoted to said closing position, said sealing means seals said opening.

5. A metallic beverage container, comprising:

a top wall having a rupturable score line defining a permanent top wall portion and an opening closure portion which is adjacent to the outer periphery of said top wall; a pivot stud located in the center of said top wall which is adjacent to said drinking opening; a pull tab pivotally connected with said pivot stud between a closing position and an opening position, said pull tab having a pull tab portion having a size at least as large as said drinking opening and a piercing portion, said pull tab portion of said pull tab also having a cut through score line which is located in said pull tab portion adjacent to said hole, the distance from the center of said pivot opening to said cut through score line being less than the distance from the center of said pivot stud to the adjacent edge of said rupturable score line wherein said pull tab portion is lifted in said opening position, said piercing portion presses on said opening closure portion to rupture said score line and form a drinking opening and wherein said pull tab is pivoted to a closing position, said pull tab portion completely covers said drinking opening and said cut through score line is located entirely over said top wall portion; and a pivotal hold down tab located adjacent to said opening, said hold down tab being pivotal from a first normal position wherein said hold down tab is located entirely over said permanent top wall portion to a second hold down position wherein a portion of said hold down tab is located over said opening whereby said hold down tab presses said pull tab portion onto said opening.

6. The container of claim 5, wherein the area immediately adjacent to said drinking opening is depressed relative to the major portion of said top wall.

7. The container of claim 6, wherein the portion of said top wall which is located immediately underneath said pull tab portion when said pull tab is in said opening position is depressed relative to the remainder of said top wall.

8. The container of claim 5, and further comprising sealing means secured to the underside of said pull tab portion of said pull tab whereby when said pull tab is pivoted to said closing position, said sealing means seals said opening.

9. The container of claim 8, wherein said sealing means has a size smaller than the size of the depressed area around said opening.

10. The container of claim 8, wherein said sealing means comprises a ring of compressible material having a shape which corresponds to the shape of said drinking opening.

11. The container of claim 10, wherein said sealing means has a size slightly smaller than the size of said drinking opening.

12. The container of claim 10, wherein the size of the outer periphery of said sealing means is larger than the size of said drinking opening.

* * * * *